US005639720A

United States Patent [19]

Antika et al.

[11] Patent Number: 5,639,720

[45] Date of Patent: Jun. 17, 1997

[54] ANTI-STAINING GEAR OILS WITH LOW STRAY MISTING PROPERTIES

[75] Inventors: Shlomo Antika, Maplewood; Richard A. Skillman, Keyport, both of N.J.

[73] Assignee: Exxon Research & Engineering Company, Florham Park, N.J.

[21] Appl. No.: 590,238

[22] Filed: Jan. 23, 1996

[51] Int. Cl.[6] ..... C10M 107/08; C10M 143/00

[52] U.S. Cl. ..... 508/591; 585/10; 585/12

[58] Field of Search ..... 585/12; 508/591

[56] References Cited

U.S. PATENT DOCUMENTS

| | | | |
|---|---|---|---|
| 3,510,425 | 5/1970 | Wilson | 252/46.6 |
| 3,805,918 | 4/1974 | Altgelt et al. | 585/12 |
| 3,855,135 | 12/1974 | Newingham et al. | 252/15 |
| 4,589,990 | 5/1986 | Zehler et al. | 252/56 S |
| 4,601,840 | 7/1986 | Zehler et al. | 252/56 S |
| 5,190,682 | 3/1993 | Harris | 252/56 S |
| 5,227,551 | 7/1993 | Bachman et al. | 585/12 |
| 5,329,055 | 7/1994 | Bachman et al. | 585/12 |

*Primary Examiner*—Ellen M. McAvoy

*Attorney, Agent, or Firm*—Joseph J. Allocca

[57] ABSTRACT

The stray misting property of anti-staining gear oil is reduced by adding to the gear oil from about 0.1 to 5 wt % polyisobutylene of about 37,000 to 140,000 Flory molecular weight.

5 Claims, No Drawings

ANTI-STAINING GEAR OILS WITH LOW STRAY MISTING PROPERTIES

BACKGROUND OF THE INVENTION

1. Field of the Invention

This invention relates to anti-staining gear oils for use in lubricating aluminum rolling mill gear and beating system and to reducing stray mist formation by such oils in the course of their use.

2. Description of the Prior Art

In aluminum rolling applications, gear oils used in systems where there is the potential of contaminating the rolling lubricant (which is applied to the surface of the aluminum being rolled), often require aluminum anti-staining (low staining) as a property. Furthermore, in some applications, for example the manufacture of aluminum foil for packaging or use in home kitchens, the gear oil has to satisfy Food and Drug Administration (FDA) food grade requirements, which impose restrictions on base stocks and additives utilized in the gear lubricant.

Polybutenes (PB's, copolymers made from isobutylene and butene monomers) have been commercially used as base stocks for aluminum anti-staining gear oils. These are mixtures of low molecular polymer grades (typically less than 2,500 number average), blended to meet the viscosity target of the lubricant. The PB base stocks would meet FDA requirements under 21 CFR 178.3570. The performance additives utilized in the formulated lubricant are low staining, and FDA compliant or non-compliant, depending on the requirements of the particular end use application.

Polyethers (FDA-compliant) and alkyl benzenes (non FDA-compliant) have also been used as base stocks for aluminum anti-stain lubricants.

Gear box and beating systems are often lubricated from a sump full of oil or a centralized oil circulation system. Stray mist formation is not a concern in these situations. Mist lubrication systems, i.e., systems where gear oils are converted into an aerosol mix in air and pneumatically delivered to the lubrication point in the form of an oil mist, have gained increased popularity since the 1960's. At the point of lubrication, devices called "reclaimers" coalesce the oil into larger droplets, and deliver it to the equipment being lubricated. It is desirable for the mist lubricant to form a low level of "stray mist" to protect the environment at the vicinity of the lubricated equipment from fogging.

Commercial mist lubricants range in ISO viscosity grades 68 to 680, more commonly ISO 100 to 460.

U.S. Pat. No. 3,510,425 teaches means to reduce stray mist in applications where mineral oil-based gear oils are utilized in a mist-type lubrication system. U.S. Pat. No. 3,5 10,425 teaches that using 0.05% to 3.5% of an oil soluble polyester of between about 80,000 to 150,000 number average molecular weight, made by esterification of $C_{12}$–$C_{20}$ alkyl monohydric alcohols and a mono-unsaturated mono carboxylic acids such as acrylic or methacrylic acids, is very effective in reducing generation of undesirable stray mist in mineral oil based mist lubricating oils. U.S. Pat. No. 3,510,425 states that, among many polymers tested unsuccessfully, polyisobutylenes (PIB's) of 130,000 number average molecular weight at 0.5 to 1.5% treat rates were not effective in reducing stray misting by mineral oil-based lubricants.

While methacrylate-type polymers used as mist control agents in mineral oil-based gear oils also function in PB based low stray misting oils, it is desirable to achieve yet higher stray mist suppression. Furthermore, use of polymethacrylates is not allowed in gear oils which need to meet Food Grade Administration (FDA) food grade requirements.

Aluminum rolling systems with mist lubricated bearings or gears therefore currently either use mineral oil-based mist oils containing mist reducing additives and accept a stain debit (and non-FDA debit, where applicable), or use PB-based gear oils which are non-staining but are accompanied with a debit in stray mist.

SUMMARY OF THE PRESENT INVENTION

It has been discovered that a reduction of stray mist formation in polybutene (PB) based aluminum anti-staining gear oils used in mist lubrication applications is achieved by use of low concentrations of polyisobutylene (PIB) of about 37,000 to 140,000 Flory molecular weight, which correspond to approximate ranges of 13,000 to 40,000 number average or 40,000 to 160,000 weight average molecular weights.

DETAILED DESCRIPTION OF THE INVENTION

Aluminum anti-staining mist lubricating gear oils are based on polybutene base oil of number average molecular weight in the range of about 300 to 2,500, preferably about 400 to 1,000 number average molecular weight or mixtures thereof. These polybutenes are used to produce gear oils in the ISO 68 to 680 viscosity grade range, preferably the ISO 100 to 460 viscosity grade, most preferably the ISO 150 to 460 viscosity grade, the grades most commonly used as aluminum anti-staining mist lubricating gear oils.

The stray mist formation of such anti-staining mist lubricating oils is reduced by addition to said oil of from 0.1 to 5 wt % preferably about 0.3 to 2.0 wt % most preferably about 0.5 to 1.5 wt % of a polyisobutylene of about 37,000 to 140,000 Flory molecular weight (approximately 13,000 to 40,000 number average or 40,000 to 160,000 weight average molecular weight), preferably about 37,000 to 100,000 Flory molecular weight (approximately 13,000 to 30,000 number average or 40,000 to 110,000 weight average molecular weight), most preferably about 37,000 to 70,000 Flory molecular weight (approximately 13,000 to 22,000 number average or 40,000 to 78,000 weight average molecular weight). Weight percents recited are based on active ingredient.

Depending on the end use application lubricant requirement, the PB-based aluminum anti-staining oils may also contain other additives such as antioxidants, anti-wear/extreme pressure agents, rust inhibitors, metal deactivators, antifoaming agents, necessary for successful operation in gear boxes and bearings. Any such additive(s) should be of the kind that does (do) not significantly degrade stain performance (readily determinable by the practitioner for his particular application) and also qualify under 21 CFR 178.3570 in such cases where compliance with FDA regulations is required.

PB's and PIB's are typically manufactured by metal halide catalyzed (aluminum trichloride or boron trifluoride) polymerization of mixed butene and isobutylene monomers. As the molecular weight of the manufactured polymers gets higher, the polymer becomes constituted from progressively more of isobutylene monomer content, becoming essentially pure polyisobutylene at high molecular weights (higher than 10,000 number average).

EXPERIMENTAL

Misting Properties of Lubricating Fluids are tested in the laboratory by ASTM Standard Test Method D 3705. The test conditions are such that oil mist is formed in a mist generator unit where oil and air temperatures are controlled at 104° F. The oil mist formed has to travel about 7 feet of tubing before it reaches a "reclassifier" fitting where oil is expected to coalesce to larger droplets, so that oil is not emitted to the environment as "stray mist". Test results are reported as percent of oil that is condensed in the line (droplets too large to be pneumatically transported), percent of oil reclaimed at the reclassifier fitting (oil delivered to the point of lubrication), and by difference, percent stray mist (unrecovered oil). The mist generator used in this test is typical of units used in industrial applications.

Evaluations were conducted with lubricants of ISO 460 viscosity grade, commonly used at aluminum rolling mills. Experience has shown that 104° F. is too low a temperature for misting ISO 460 grade lubricants. For this reason the test procedure was modified so that testing was conducted after adjustment of mist head air temperatures to 140° F., 160° F. and 180° F., which are temperatures more representative of field operation conditions.

EXAMPLES

An ISO 460 viscosity formulated aluminum anti-staining oil comprising a polybutene base stock mixture of about 500 to 550 number average (or 1000 to 1200 weight average) molecular weight and additives was used as the test base fluid.

This oil contained standard additives common to aluminum anti-staining mist lubricating oils such as antioxidants, anti-wear/extreme pressure agents, rest inhibitors, metal deactivators, anti foaming agent in a total amount of about 2.0 wt %. The base formulated oil is identified as Oil A. The test lubricants were derived from the base fluid formulated lubricating oil (Oil A) by retaining all the same additives (except for the anti-misting additive under investigation) and adjustment of the base stock viscosity being employed as the means to maintain the lubricant formula formulation within the ISO 460 viscosity grade (414 cSt to 506 cSt at 40° C.). Exxon Enmist EP 460 (TM) a mineral based low stray misting oil was used as a reference oil.

To different portions of the PB-based lubricant formulation (Oil A) were added different amounts of polymethacrylate polymer (65–85% copolymer in mineral oil solvent) of about 130,000 number average (270,000 weight average) molecular weight of the type taught in U.S. Pat. No. 3,5 10,425 for controlling stray mist in mineral oil based mist lubricant oils, and different amounts of 2,300 number average/6,000 weight average molecular weight PIB (low MW PIB) and 13,000 number average/43,000 weight average molecular weight PIB (high MW PIB). The high MW PIB is reportedly of typical 44,000 Flory molecular weight. Flory molecular weight of a polymer is commonly referenced in establishing compliance with 21 CFR 178.3570 FDA food grade requirements.

The ISO 460 oils tested are presented below in Table 1.

TABLE 1

ISO 460 Oils Tested

| OIL | DESCRIPTION |
|---|---|
| Enmist EP 460 ™ | Mineral oil-based mist low stray misting oil |
| Oil A | PIB-based aluminum anti-staining oil |

TABLE 1-continued

ISO 460 Oils Tested

| OIL | DESCRIPTION |
|---|---|
| Oil A/0.5% MA | Oil A, viscosity corrected, with 0.5% polymethacrylate anti-mist agent |
| Oil A/1.0% MA | Oil A, viscosity corrected, with 1.0% polymethacrylate anti-mist agent |
| Oil A/2.0% MA | Oil A, viscosity corrected, with 2.0% polymethacrylate anti-mist agent |
| Oil A/2.0% Low MW PIB | Oil A, viscosity corrected, with 2% 2,300 $MW_{number}$ (low MW PIB) |
| Oil A/5.0% Low MW PIB | Oil A, viscosity corrected, with 5% 2,300 $MW_{number}$ (Low MW) PIB |
| Oil A/10.0% Low MW PIB | Oil A, viscosity corrected, with 10% 2,300 $MW_{number}$ (Low MW) PIB |
| Oil A/0.5% High MW PIB | Oil A, viscosity corrected, with 0.5% 44,000 $MW_{Flory}$ (High MW) PIB |
| Oil A/1.0% High MW PIB | Oil A, viscosity corrected, with 1.0% 44,000 $MW_{Flory}$ (High MW) PIB |
| Oil A/2.0% High MW PIB | Oil A, viscosity corrected, with 2% 44,000 $MW_{Flory}$ (High MW) PIB |
| Oil A/4.0% High MW PIB | Oil A, viscosity corrected, with 4% 44,000 $MW_{Flory}$ (High MW) PIB |

Stray mist measurements were made at 140° F., 160° F. and 180° F. are shown below. Results obtained include oil output from the mist generator, and distribution of this oil mount three components: % line condensate, % stray mist, and % reclassified.

TABLE 2-A

Mist Performance of ISO 460 Oils at 140° F. Mist Air Temperature

| Oil | Output (g/hour) | Line Condensate | Stray Mist | Reclassified |
|---|---|---|---|---|
| Enmist EP 460 ™ | 28.7 | 8.3% | 11.4% | 80.2% |
| Oil A | 44.6 | 5.5% | 25.2% | 69.3% |

TABLE 2-B

Mist Performance of ISO 460 Oils at 180° F. Mist Air Temperature

| Oil | Output (g/hour) | Line Condensate | Stray Mist | Reclassified |
|---|---|---|---|---|
| Enmist EP 460 ™ | 46.1 | 7.4% | 13.2% | 79.4% |
| Oil A | 59.9 | 6.0% | 27.2% | 66.8% |

Results from Table 2-A and 2-B show the effect of mist air temperature and the difference between an anti-mist additive-containing mineral oil and an untreated PB base stock-based gear oil. It can be observed that Oil A results in higher oil delivery rates, but very significantly, more than double the concentration of stray mist, compared to Enmist EP 460™. This occurs at all test temperatures.

Secondly, at the higher mist air temperature, the oil output from the generator rises. However, raising temperature does not significantly change the ratios of condensed, reclaimed, and stray mist oil although actual oil volumes, obviously, are increased. Raising air temperature at the mist generator is a common technique used in industrial plants to increase the amount of lubricant delivered to mist lubricated equipment.

Having established the base line oil performance at two temperatures, anti-mist additive derived formulations were evaluated at 160° F. mist generator air temperature. The testing was carded out in two sets, the second set initiated after positive results were observed with the high MW PIB at 2% and 4%, to determine effects at lower treat rates. Oil A, the PB base stock-based aluminum anti-staining oil, was tested with both sets, to confirm the good repeatability of test results.

TABLE 2-C

Mist Performance of ISO 460 Oils at 160° F. Mist Air Temperature

| Oil | Test Set | Output (g/hour) | Line Condensate | Stray Mist | Reclassified |
|---|---|---|---|---|---|
| Enmist EP 460 ™ | 1 | 39.0 | 7.5% | 12.4% | 80.0% |
| Oil A | 1 | 55.7 | 5.4% | 28.9% | 65.7% |
| Oil A | 2 | 55.0 | 5.7% | 27.3% | 67.0% |
| Oil A/0.5% MA | 1 | 48.4 | 7.6% | 15.9% | 76.5% |
| Oil A/1.0% MA | 1 | 43.2 | 7.6% | 13.8% | 78.6% |
| Oil A/2.0% MA | 1 | 44.8 | 8.4% | 12.2% | 79.4% |
| Oil A/2.0% Low MW PIB | 1 | 56.3 | 5.6% | 25.0% | 69.3% |
| Oil A/5.0% Low MW PIB | 1 | 57.4 | 5.6% | 24.4% | 70.0% |
| Oil A/10.0% Low MW PIB | 1 | 58.5 | 5.4% | 25.1% | 69.5% |
| Oil A/0.5% High MW PIB | 2 | 32.2 | 12.2% | 8.5% | 79.3% |
| Oil A/1.0% High MW PIB | 2 | 25.3 | 14.3% | 8.6% | 77.1% |
| Oil A/2.0% High MW PIB | 1 | 23.2 | 14.0% | 7.8% | 78.2% |
| Oil A/4.0% High MW PIB | 1 | 19.6 | 12.0% | 15.8% | 72.2% |

The observation is made first that the polymethacrylate stray mist reducing additive can reduce into about half the extent of stray mist generated by Oil A. The low MW PIB additive is not effective even at as high as 10% treat rate.

The unexpected result was the remarkable effectiveness of the nominally about 44,000 Flory molecular weight PIB in reducing stray mist. Contrary to the experience with mineral oil base stocks as described in U.S. Pat. No. 3,510,425, this additive was able to reduce stray mist to about one half of what was achievable with the polymethacrylate additive, and to about one quarter of the base line spray mist level set by Oil A. Effective mist suppression is observed in the range of 0.5% to 2.0% treat rate.

It was indicated earlier that any additive used in aluminum anti-staining lubricants should have no significant deleterious effects on the staining tendency of the lubricant. In the case of use of high MW PIB's, the concern is formation of a tacky residue. Evaluations of staining/tackiness effects are conducted in a high temperature muffler furnace. Oil is dropped on the surface aluminum specimens (foil dishes), and these are visually and manually evaluated for stain and tackiness after aging (annealing) at various temperatures (470° F. to 670° F.) and durations (30 to 60 minutes). Such experiments indicate that up to 2% concentration, the high molecular weight PIB additive does not increase the extent of stain or tackiness over the level of the baseline lubricant, Oil A. Above the 2% concentration of the higher molecular weight PIB, the lubricant residue starts to become more tacky after having undergone high temperature aging (annealing) in the muffler furnace.

Finally, to retain the FDA status of the lubricant, only PIB's in the range of 37,000 minimum, 140,000 maximum Flory molecular weight should be used as an anti-mist agent in PB based aluminum anti-staining lubricants. It is anticipated that PIB's of Flory molecular weight higher than 140,000 would also have an anti-staining/tackiness debit due to insufficient decomposition during the hot annealing of rolled aluminum products.

What is claimed is:

1. An anti-staining mist lubricating gear oil in the ISO 68 to 680 viscosity grade range comprising a major amount of polybutene base oil of number average molecular weight in the range of about 300 to 2,500 or mixtures thereof and a minor amount of additives comprising about 0.1 to 5.0 wt % polyisobutylene of about 37,000 to 140,000 Flory molecular weight.

2. The anti-staining mist lubricating gear oil of claim 1 wherein the polyisobutylene of about 37,000 to 100,000 Flory molecular weight.

3. The anti-staining mist lubricating gear oil of claim 1 wherein the polyisobutylene is of about 37,000 to 70,000 Flory molecular weight.

4. The anti-staining mist lubricating gear oil of claim 1, 2 or 3 wherein the polyisobutylene is present in an amount of about 0.3 to 2.0 wt %.

5. The anti-staining mist lubricating gear oil of claim 4 wherein the polyisobutylene is present in an amount of about 0.5 to 1.5 wt %.

* * * * *